US006506103B1

(12) United States Patent
Ohmori et al.

(10) Patent No.: US 6,506,103 B1
(45) Date of Patent: Jan. 14, 2003

(54) ELID CENTERLESS GRINDING APPARATUS

(75) Inventors: Hitoshi Ohmori, Wako (JP); Nobuhide Itoh, Hitachi (JP)

(73) Assignee: Riken (JP)

( * ) Notice: Subject to any disclaimer, the term of this patent is extended or adjusted under 35 U.S.C. 154(b) by 43 days.

(21) Appl. No.: 09/621,075

(22) Filed: Jul. 21, 2000

(30) Foreign Application Priority Data

Jul. 23, 1999 (JP) ..... 11-208796

(51) Int. Cl.[7] ..... B24B 99/18

(52) U.S. Cl. ..... 451/72; 451/49; 451/56; 451/21; 451/443; 451/243

(58) Field of Search ..... 451/49, 56, 72, 451/243, 443, 21

(56) References Cited

U.S. PATENT DOCUMENTS

| | | | | |
|---|---|---|---|---|
| 4,570,386 A | | 2/1986 | Unno et al. | |
| 5,660,579 A | * | 8/1997 | Nakayama et al. | 451/21 |
| 5,766,057 A | * | 6/1998 | Maack | 451/21 |
| 5,868,607 A | * | 2/1999 | Enomoto et al. | 451/56 |
| 5,928,065 A | * | 7/1999 | Shih | 451/72 |
| 6,110,019 A | * | 8/2000 | Ohmori | 451/72 |
| 6,113,464 A | * | 9/2000 | Ohmori et al. | 451/41 |
| 6,123,605 A | | 9/2000 | Yano | |
| 6,213,843 B1 | * | 4/2001 | Kramer | 451/5 |

FOREIGN PATENT DOCUMENTS

| | | | |
|---|---|---|---|
| JP | 62-264964 | * 11/1987 | 451/56 |
| JP | 03-251353 A | 11/1991 | |
| JP | 08-081275 A | 3/1996 | |
| JP | 10-175165 A | 6/1998 | |
| JP | 10-230439 A | 9/1998 | |
| JP | 10-230459 A | 9/1998 | |

* cited by examiner

*Primary Examiner*—George Nguyen
(74) *Attorney, Agent, or Firm*—Griffin & Szipl, P.C.

(57) ABSTRACT

An ELID centerless grinding apparatus comprising: a blade 2 for horizontally supporting a rotator workpiece 1 and and a regulating wheel 10 driven to rotate around a horizontal shaft center. An outer surface of the workpiece is subjected to ELID grinding by using a conductive grinding wheel 4. An outer peripheral portion of the wheel 10 includes a conductive elastic member 11 and abrasion resisting particles 12. An electrolytic electrode 14 is provided in close vicinity to an outer peripheral surface of the wheel 10. An electrolytic power supply 16 applies an electrolytic voltage between the electrolytic electrode and the wheel. A conductive electrolytic fluid is flow between the electrode and the wheel and the member 11 is removed by the electrolytic dressing to cause the abrasion resisting particles 12 to project, while the particles 12 are brought into contact with the outer peripheral surface of the workpiece 1 to rotate around its shaft center. Consequently, the coefficient of friction of the outer peripheral surface shape of the regulating wheel 3 with respect to the workpiece can be maintained more or less constant during the grinding process of the workpiece.

2 Claims, 3 Drawing Sheets

ELID CENTERLESS GRINDING APPARATUS

BACKGROUND OF THE INVENTION

1. Field of the Invention

The present invention relates to an ELID centerless grinding apparatus for grinding an extra-fine component or an elongated component in the centerless manner.

2. Description of the Prior Art

As the optical communications or ultraprecision devices are developed, the needs for ultraprecision small-diameter cylindrical components used in ferrule or micro machine parts is increased, and the highly efficient and ultraprecise production technique is demanded. As such ultraprecision small-diameter cylindrical components, there are, for example, a fiber guide for an optical fiber connector, a needle of a needle bearing, a head of a dot printer and others. Application of the centerless grinding machine is suitable for processing an outside diameter of such a component having an extremely fine diameter (for example, not less than several mm) or that having high aspect ratio.

FIG. 1 is a block diagram showing an ELID centerless grinding apparatus reported by the inventor of the present invention ("Development and Practical Application of the ELID Processing Machine and System No. 4", Tool Engineers, October 1998).

As shown in the drawing, an elongated workpiece 1 is mounted on a blade 2 having a slant surface on an upper surface thereof and brought into contact with an outer peripheral surface of a regulating wheel 3 to rotate around a shaft center of the workpiece 1. On the other hand, an ELID electrode 5 and a discharge electrode 6 are provided in close vicinity to the outer peripheral surface of a conductive grinding wheel 4 such as a bronze-iron composite bond and the like, and a voltage for discharge or a voltage for electrolysis can be applied between these electrodes and the grinding wheel 4 by an ELID power supply 7.

With such a structure, precision truing of the outer peripheral surface of the grinding wheel can be carried out by discharge truing which can cause discharge between the discharge electrode 6 and grinding wheel 4 so that the very accurate grinding wheel surface having the straightness of 4 $\mu$m/W50 mm and the roundness of 2 $\mu$m/$\phi$150 mm can be obtained.

Further, a conductive electrolytic fluid 8 is supplied between the ELID electrode 5 and the grinding wheel 4 while performing the initial dressing of the grinding wheel 4 therebetween. Subsequently, the electrolytic dressing of the grinding wheel 4 is carried out while conducting the electrolytic in-process dressing grinding (ELID grinding) for grinding the workpiece 1 is performed. Consequently, it is possible to obtain ceramics (zirconia ferrule) or nitrided SKD 61 (hardness of 1000 HV) having a diameter of 2.5 mm which has the surface roughness of not more than Rz 0.15 $\mu$m and the straightness of not more than Rp 0.15 $\mu$m.

However, the above-described ELID centerless grinding apparatus has such a problem as that the outer peripheral surface shape of the regulating wheel 3 changes due to the long use. For example, in the in-feed grinding for grinding without feeding the workpiece, a part which comes into contact with the workpiece is worn away due to abrasion and, as a result, an contact area with the workpiece changes, which disables the smooth rotation. Further, in the through-feed grinding for grinding while feeding the workpiece, the regulating wheel 3 is partially worn away, thereby similarly disabling the smooth rotation.

Moreover, even if the outer peripheral shape does not change, when the surface aspect of the regulating wheel 3 changes to vary the coefficient of friction, the workpiece can not be smoothly rotated, and there occurs such problems as that the workpiece is processed to be flat (sectional shape distorted from the perfect circle).

When these problems occur, the regulating wheel 3 is removed from the apparatus to correct the shape in the offline manner or an additionally provided working tool is used to correct the outer peripheral surface on the machine without removing the regulating-wheel 3 from the apparatus in the prior art.

However, since the re-sharpening changes the coefficient of friction with respect to the workpiece in either case, the stable grinding is difficult under the same conditions. Further, in case of re-sharpening in offline in particular, attachment/reattachment disables the precise centering.

SUMMARY OF THE INVENTION

The present invention is made to solve the above-described problems. That is, an object of the present invention is to provide an ELID centerless grinding apparatus which can keep the coefficient of friction of the outer peripheral surface shape of the regulating wheel 3 with respect to the workpiece substantially constant during the grinding process of the workpiece.

According to the present invention, there is provided an ELID centerless grinding apparatus comprising: a blade (2) for horizontally supporting a rotator workpiece (1) and having a slant surface inclined outwards and downwards; and a regulating wheel (10) driven to rotate around a horizontal shaft center, a conductive grinding wheel (4) being used to ELID-grind the outer surface of the workpiece, an outer peripheral portion of the regulating wheel (10) including a conductive elastic member (11) and abrasion resisting particles (12) held by the member (11), and further comprising: an electrolytic electrode (14) provided in close vicinity to the outer peripheral surface of the regulating wheel (10); and an electrolytic power supply (16) for applying a voltage for electrolysis between the electrolytic electrode and the regulating wheel (10), the conductive electrolytic fluid flowing between the electrolytic electrode and the regulating wheel (10), the conductive elastic member (11) being removed by the electrolytic dressing, the abrasion resisting particles (12) being projected to rotate around a shaft center of the workpiece in contact with the outer peripheral surface of the workpiece.

According to the structure of the present invention, when the electrolytic voltage is applied between the electrolytic electrode (14) and the regulating wheel (10) by the electrolytic power supply (16) to subject the conductive elastic member (11) of the regulating wheel (10) to the electrolytic dressing while supplying the conductive electrolytic fluid 8 between the electrolytic electrode (14) and the regulating wheel (10), the conductive elastic member (11) can be removed by the electrolytic dressing to keep the outer peripheral surface shape of the regulating wheel (10) substantially constant during the grinding process of the workpiece, and a quantity of projection of the abrasion resisting particles (12) can be adjusted to keep the coefficient of friction with respect to the workpiece substantially constant.

According to a preferred embodiment of the present invention, the conductive elastic member (11) is a mixture of a elastic member and conductive particles.

With this structure, desired conductivity can be imparted to the conductive elastic member (11) by the conductive particles and the elasticity can be given to the same by the elastic member.

Other objects and advantageous features of the present invention will be apparent from the following description in conjunction with the accompanying drawings.

DESCRIPTION OF THE PREFERRED EMBODIMENT

Figure 1:
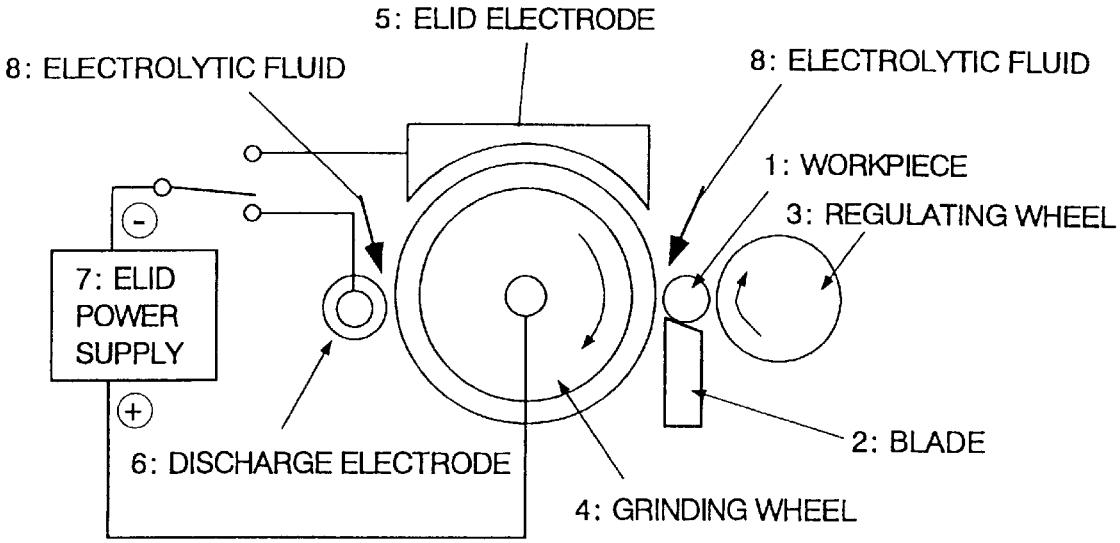
FIG. 1 (PRIOR ART)
FIG. 1 is a block diagram showing a prior art ELID centerless grinding apparatus.

A preferred embodiment according to the present invention will now be described with reference to the drawings. Like reference numerals denote corresponding parts throughout the drawings to avoid tautological explanation.

Figure 2:
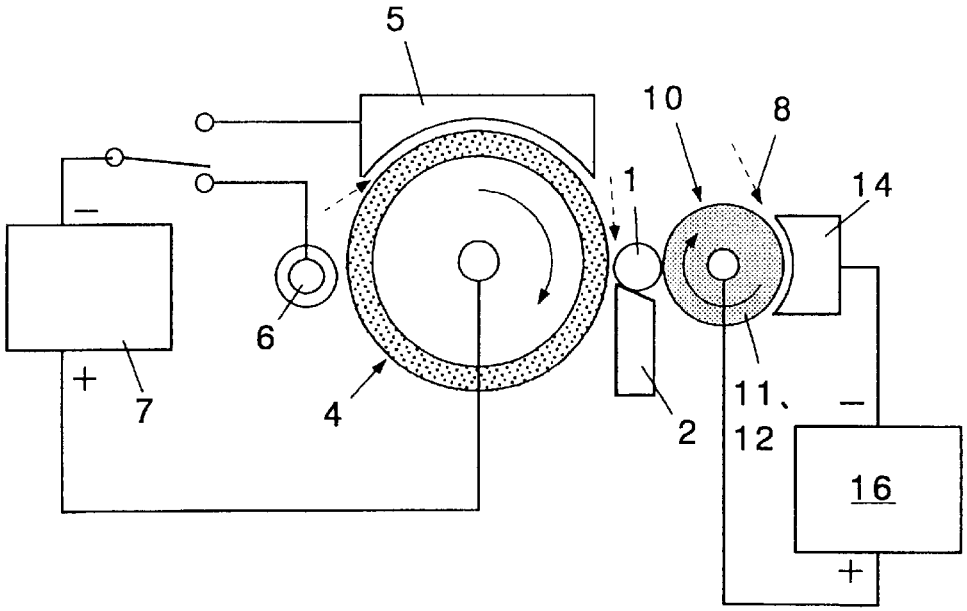
FIG. 2 is a block diagram showing an overall ELID centerless grinding apparatus according to the present invention.
Figure 3:
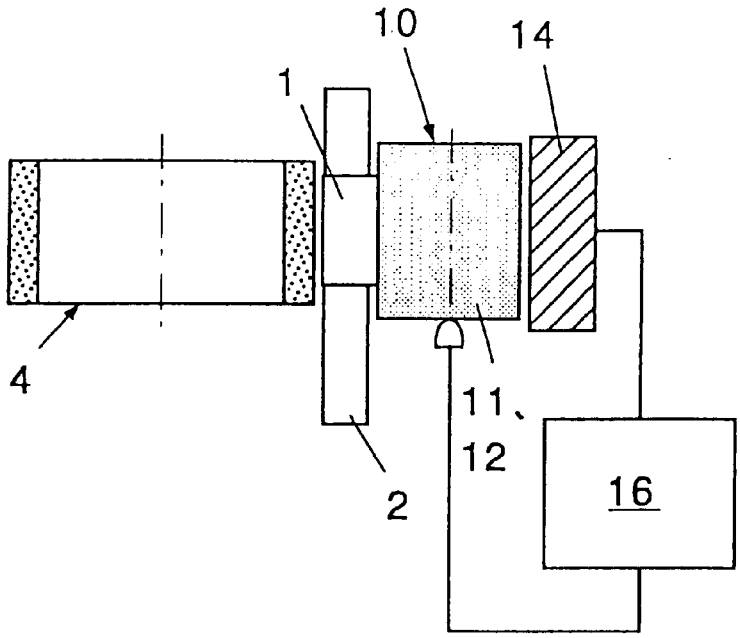
FIG. 3 is a partial plan view of FIG. 2.

FIG. 2 is a block diagram showing an overall ELID centerless grinding apparatus according to the present invention, and FIG. 3 is a partial plan view of FIG. 2. As shown in FIGS. 2 and 3, the ELID centerless grinding apparatus according to the present invention includes a blade 2 for horizontally supporting a rotator workpiece 1 and having a slant surface inclined outwards and downwards and a regulating wheel 10 which is driven to rotate around a horizontal shaft center and ELID-grinds the outer surface of the workpiece by using a conductive grinding wheel 4.

The conductive grinding wheel 4 is, for example, a bronze-iron composite bond grinding wheel and impressed to be positive by an ELID power supply 7 (direct current pulse power supply). An ELID electrode 5 and a discharge electrode 6 are provided in close vicinity to an outer peripheral surface of the conductive grinding wheel 4 and, when the switch is changed over, the ELID power supply 7 applies a negative voltage to the discharge electrode 6 or the-ELID electrode 5.

With this structure, the electro-discharge truing causing discharge between the discharge electrode 6 and the grinding wheel 4 can perform the precision truing of the grinding wheel outer peripheral surface. In addition, a conductive electrolytic fluid 8 is supplied between the ELID electrode 5 and the grinding wheel 4 while the initial dressing of the grinding wheel 4 is conducted therebetween, and the electrolytic in-process dressing grinding (ELID grinding) is then carried out that performs the electrolytic dressing of the grinding wheel 4 while grinds the workpiece 1, thereby obtaining the excellent processed surface roughness and straightness.

Figure 4:
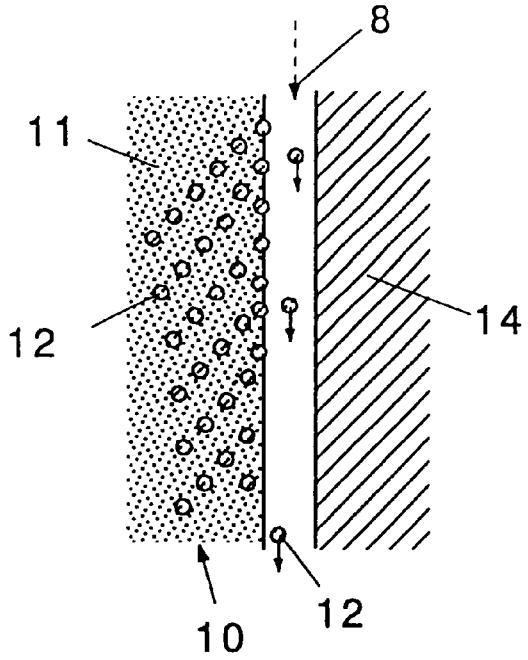
FIG. 4 is a schematic drawing of the electrolytic dressing of a regulating wheel.

FIG. 4 is a schematic drawing of a regulating wheel 10. As shown in this drawing, the outer peripheral portion of the regulating wheel 10 is constituted by a conductive elastic member 11 and abrasion resisting particles 12 held by the former member 11. The abrasion resisting particles 12 are made up of microscopic particles having with the high degree of hardness such as alumina ($Al_2O_3$), silicon carbide (SiC) and others and projects on the surface of the regulating wheel 10 so that the coefficient of friction with the workpiece 1 is increased while the wear of the regulating wheel 10 is reduced. Further, the conductive elastic member 11 is a mixture of the elastic member and the conductive particles. As the elastic member, for example, rubber, resin and any other plastic can be used. Furthermore, as the conductive particles, there are, copper powder, iron powder as well as a semiconductor. In addition, an aggregate of multiple metals, the combination of metal particles and resin fine particles, that of metal particles and semiconductor particles, and that of semiconductor particles and resin fine particles (the resin described herein is a material different from the elastic member) can suffice the conductive particles.

The regulating wheel 10 can be manufactured by, for example, mixing and pressing the elastic member, the conductive particles and the abrasion resisting particles to obtain a desired shape, further applying sintering process, and integrating the conductive member 11, thereby firmly holding the abrasion resisting particles 12. It is to be noted that any other method may used to manufacture the regulating wheel 10 by, for example, fusing the elastic member including the conductive particles and the abrasion resisting particles and filling it in a predetermined die.

In FIGS. 2 and 3, the ELID centerless grinding apparatus according to the present invention comprises: an electrolytic electrode 14 provided in close vicinity to the outer peripheral surface of the regulating wheel 10 and an electrolytic power supply 16 for applying an electrolytic voltage between the electrolytic electrode 14 and the regulating wheel 10.

The surface of the electrolytic electrode 14 opposed to the regulating wheel 10 is smoothly formed so as to be separated with a predetermined gap therebetween. In addition, the conductive electrolytic fluid 8 is caused to flow to the gap. The electrolytic power supply 16 is a direct current power supply or a direct current pulse power supply as similar to the ELID power supply 7, and the conductive elastic member 11 is impressed to be positive while the negative voltage is applied to the electrolytic electrode 14 at any time as the need arises. Although the electrolytic power supply 16 and the ELID power supply 7 are separately provided in this example, they may be integrated.

With this structure, the conductive elastic member 11 is removed by the electrolytic dressing, and the abrasion resisting particles 12 are caused to protrude and brought into contact with the outer peripheral surface of the workpiece 1 to rotate around the shaft center. Further, the grinding wheel 4 is subjected to the electrolytic dressing while the workpiece 1 can be ground by the ELID grinding.

FIG. 3 shows the in-feed grinding for grinding the workpiece 1 without moving it in the axial direction.

Figure 5:
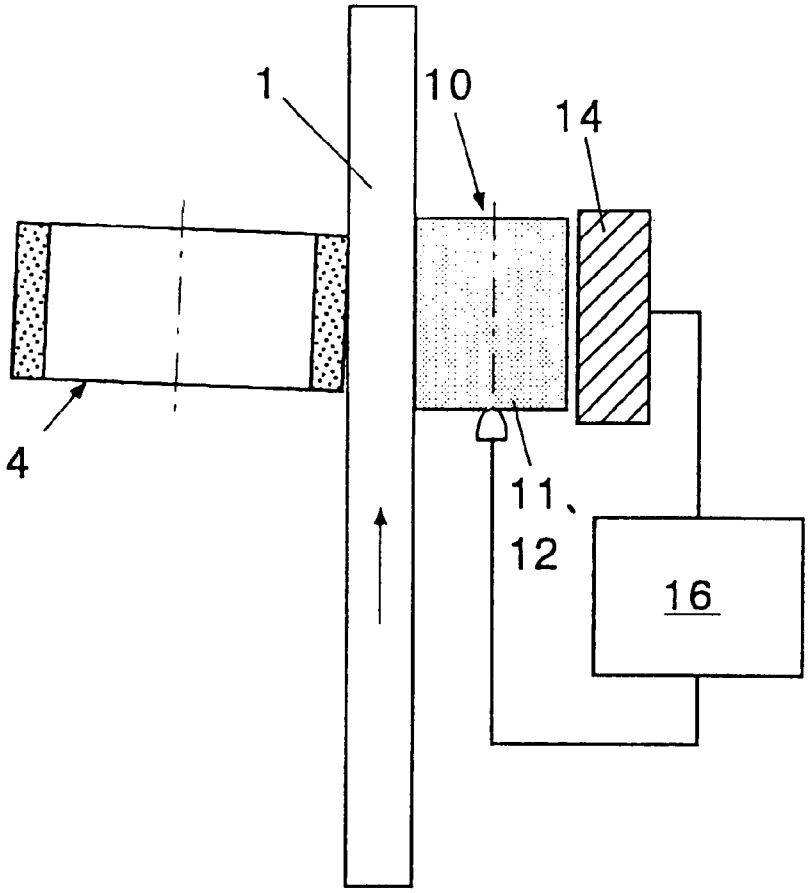
FIG. 5 is another partial plan view showing similar to FIG. 2.

FIG. 5 is another partial plan view similar to FIG. 3. This drawing shows the through-feed grinding by which the workpiece 1 is ground while being fed in the axial direction. In this example, the rotating shaft of the conductive grinding wheel 4 is not completely parallel to the rotating shaft of the regulating wheel 10 but slightly inclined. In this structure, even if the workpiece 1 is very long, the workpiece can be elongated by continuously processing it by using the conductive grinding wheel 4 while feeding the workpiece in the axial direction. It is to be noted that any other configuration is similar to that of FIG. 3.

As described above, according to the structure of the present invention, the conductive electrolytic fluid 8 is supplied between the electrolytic electrode 14 and the regulating wheel 10 while the electrolytic voltage is applied between these members by the electrolytic power supply 16, and the conductive elastic member 11 of the regulating wheel 10 is subjected to the electrolytic dressing. Consequently, the conductive elastic member 11 is removed by the electrolytic dressing, and the outer peripheral surface shape of the regulating wheel 10 can be maintained substantially constant during the grinding process of the workpiece, and the coefficient of friction with respect to the workpiece can be kept nearly constant by regulating a quantity of projection of the abrasion resisting particles 12.

Therefore, the ELID centerless grinding apparatus according to the present invention has an excellent advantage such that the coefficient of friction of the outer peripheral surface shape of the regulating wheel 10 with respect to the workpiece can be maintained substantially constant during the grinding process of the workpiece.

Although the present invention has been explained based on a few preferred embodiments, it will be understood that the scope included in the present invention is not restricted to these embodiments. On the contrary, the scope of the present invention includes all improvements, modifications and equivalents contained in the appended claims.

What is claimed is:

1. An ELID centerless grinding apparatus comprising: a blade for horizontally supporting a rotator workpiece and having a slant surface inclined outwards and downwards; and a regulating wheel driven to rotate around a horizontal shaft center, the apparatus performing ELID grinding of a workpiece outer surface by using a conductive grinding wheel, an outer peripheral portion of the regulating wheel including a conductive elastic member and abrasion resisting particles held in the conductive elastic member, the apparatus further comprising: an electrolytic electrode provided in close vicinity to an outer peripheral surface of the regulating wheel; and an electrolytic power supply for applying an electrolytic voltage between the electrolytic electrode and the regulating wheel, thereby, a conductive electrolytic fluid being caused to flow between the electrolytic electrode and the regulating wheel, the conductive elastic member being removed by the electrolytic dressing to cause the abrasion resisting particles to project while the abrasion resisting particles being brought into contact with the outer peripheral surface of the workpiece to rotate around its shaft center.

2. The ELID centerless grinding apparatus according to claim 1, wherein the conductive elastic member is a mixture of an elastic member and conductive particles.

* * * * *